US008544303B2

(12) United States Patent
Andersson

(10) Patent No.: US 8,544,303 B2
(45) Date of Patent: Oct. 1, 2013

(54) ELECTROMECHANICAL LOCK DEVICE

(75) Inventor: Daniel Andersson, Eskilstuna (SE)

(73) Assignee: ASSA AB, Eskilstuna (SE)

( * ) Notice: Subject to any disclaimer, the term of this patent is extended or adjusted under 35 U.S.C. 154(b) by 866 days.

(21) Appl. No.: 11/912,609

(22) PCT Filed: Apr. 27, 2006

(86) PCT No.: PCT/SE2006/000506

§ 371 (c)(1),
(2), (4) Date: Jan. 15, 2008

(87) PCT Pub. No.: WO2006/118521

PCT Pub. Date: Nov. 9, 2006

(65) Prior Publication Data

US 2008/0134736 A1 Jun. 12, 2008

(30) Foreign Application Priority Data

Apr. 29, 2005 (SE) ..... 0500977

(51) Int. Cl.
*E05B 49/00* (2006.01)

(52) U.S. Cl.
USPC ..... 70/278.7; 70/278.3; 70/283; 70/496

(58) Field of Classification Search
USPC ..... 70/276, 277, 278.1, 278.2, 278.3, 70/278.7, 283, 495, 496
See application file for complete search history.

(56) References Cited

U.S. PATENT DOCUMENTS

| | | | | |
|---|---|---|---|---|
| 4,638,651 | A * | 1/1987 | Surko, Jr. | 70/495 |
| 4,732,022 | A * | 3/1988 | Oliver | 70/406 |
| 5,507,162 | A * | 4/1996 | Chhatwal | 70/278.3 |
| 5,552,777 | A * | 9/1996 | Gokcebay et al. | 70/278.3 |
| 5,839,307 | A * | 11/1998 | Field et al. | 70/283 |
| 6,318,137 | B1 * | 11/2001 | Chaum | 70/278.3 |
| 6,564,600 | B1 * | 5/2003 | Davis | 70/277 |
| 6,564,601 | B2 * | 5/2003 | Hyatt, Jr. | 70/278.3 |
| 6,604,394 | B2 * | 8/2003 | Davis | 70/278.3 |

(Continued)

FOREIGN PATENT DOCUMENTS

| | | |
|---|---|---|
| EP | 1134335 A2 | 9/2001 |
| WO | 98/36142 A1 | 8/1998 |

(Continued)

OTHER PUBLICATIONS

New Zealand Examination Report issue in New Zealand Application No. 563570 dated Dec. 14, 2010 (2 pages).

*Primary Examiner* — Christopher Boswell
(74) *Attorney, Agent, or Firm* — Sughrue Mion, PLLC

(57) ABSTRACT

A lock device is provided that includes a housing (2) having an opening (4) and a core (10) which is rotatably mounted in the opening (4) about a longitudinal axis of the core and which includes a key way (12) for reception of a key. Also included is a latching dement (20) that co-acts between the housing (2) and the core (10). An electronically controllable actuator (30) is mounted in the core (10) and is movable using a motor (40) between an opening-registering position in which movement of the latching element (20) to the release position is permitted, and a latching position in which movement of the latching element (20) to the release position is blocked. The motor (40) is provided in a recess (10a) in the barrel surface (10b) of the core at a distance from the end surfaces of the core.

11 Claims, 3 Drawing Sheets

(56) References Cited

U.S. PATENT DOCUMENTS

| | | | | |
|---|---|---|---|---|
| 6,615,625 | B2 * | 9/2003 | Davis | 70/278.3 |
| 6,718,806 | B2 * | 4/2004 | Davis | 70/278.3 |
| 6,895,792 | B2 * | 5/2005 | Davis | 70/278.3 |
| 7,640,773 | B2 * | 1/2010 | Bellamy et al. | 70/278.3 |
| 7,690,231 | B1 * | 4/2010 | Field et al. | 70/278.3 |
| 7,870,769 | B2 * | 1/2011 | Andersson | 70/278.7 |
| 7,874,190 | B2 * | 1/2011 | Krisch et al. | 70/277 |
| 2004/0080039 | A1 | 4/2004 | Araya | |

FOREIGN PATENT DOCUMENTS

| | | | |
|---|---|---|---|
| WO | 0148341 | A1 | 7/2001 |
| WO | 03100199 | A1 | 12/2003 |
| WO | 2004051033 | A1 | 6/2004 |
| WO | 2005/001224 | A1 | 1/2005 |

* cited by examiner

ELECTROMECHANICAL LOCK DEVICE

CROSS REFERENCE TO RELATED APPLICATIONS

This application is a National Stage of International Application No. PCT/SE2006/000506 filed on Apr. 27, 2006, claiming priority based on Swedish Patent Application No. 0500977-4, filed Apr. 29, 2005, the contents of all of which are incorporated herein by reference in their entirety.

FIELD OF INVENTION

The present invention relates generally to an electromechanical lock device and then particularly to a lock device in which an electrically or electromechanically operated latch mechanism is provided in a recess in the barrel surface of a lock core.

BACKGROUND OF THE INVENTION

Electromechanical lock devices that include an electrically co-acting or controlled latching mechanism for manoeuvring a lock cylinder are known to the art. For example, U.S. Pat. No. 5,839,307, the Swedish patent SE 9904771-4, and the European patent publication EP 1 134 335 A2 describe such lock devices. It is there described how an actuator is rotated by means of an electric motor. The actuator in turn permits or prevents the movement of a side bar.

In order to achieve greater flexibility it is preferred that the latching mechanism is entirely included in the cylinder core. In this way you can use the same lock cylinder housing as in all-mechanical lock devices. However, the problem is that the space in the cylinder core is limited and that the assembly of the latching mechanism can be difficult to realize in a simple way.

A known way to assemble a latching mechanism entirely provided in the core is to drill a hole in the inner end surface of the core, which extends in the longitudinal direction of the core. The drawback with this solution is that such a hole in the end surface limits the placement of other parts in the lock device, such as the coupling of a follower to the core.

It is also known to provide the latching mechanism in a recess in the barrel surface of the core, see for example the above mentioned European patent publication EP 1 134 335 A2. A drawback associated with this solution is that a cover must be provided, which keeps the actuator and the side bar in place. This leads to a weakening of the latching mechanism since the cover can yield when the core is subjected to large turning forces.

SUMMARY OF THE PRESENT INVENTION

An object of the present invention is to provide a lock device of the above kind in which the electrically controlled latch mechanism exhibits more security than in prior art devices and which also is easier to assemble.

The invention is based on the insight that a bore can be provided by means of a cutter or mill, which bore extends parallel to the longitudinal direction of the core and in which the actuator is provided. This, in combination with the fact that the latching element is provided in a slit provided between the bore and the barrel surface of the core, solves the above mentioned problem in prior art.

Accordingly, the invention provides a lock device according to claim 1.

One advantage afforded by the inventive lock device is that forces on the side bar are taken up by the core itself, which improves the security. The recess provided at a distance from the end surfaces of the core also gives a flexible solution as regards assembly.

BRIEF DESCRIPTION OF THE DRAWINGS

The invention will now be described by way of example and with reference to the accompanying drawings, in which.

DETAILED DESCRIPTION OF THE INVENTION

Figure 1:
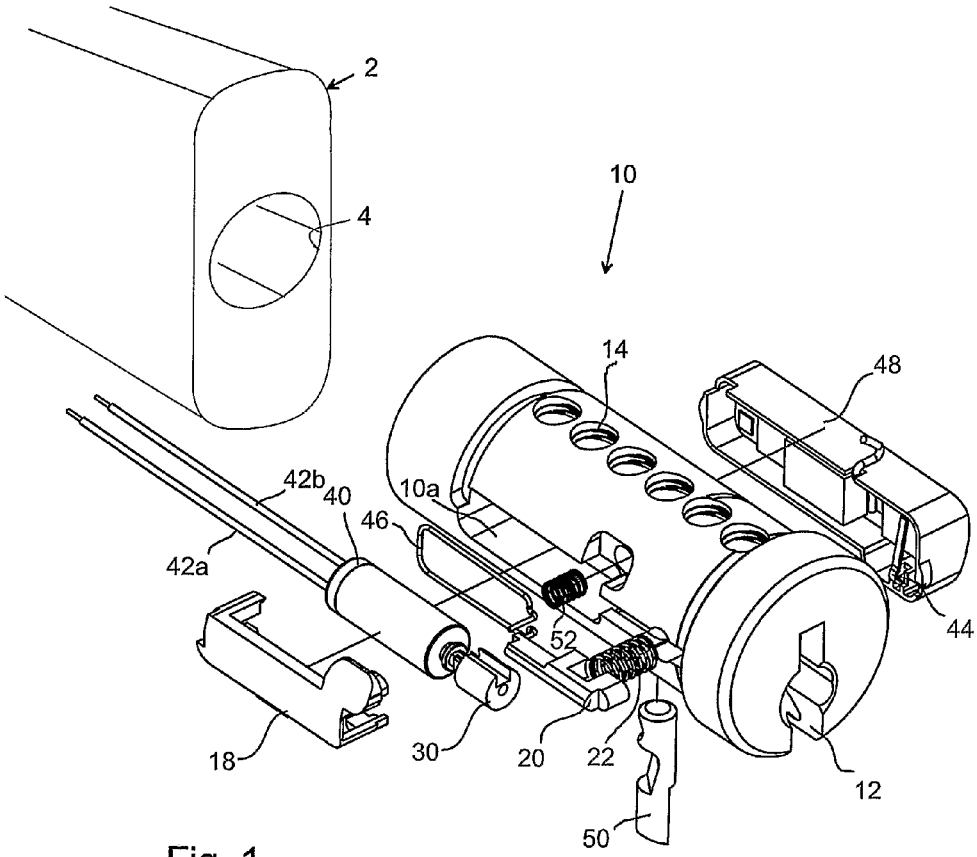
FIG. 1 is a perspective view of a lock device according to the present invention.

There follows a detailed description of preferred embodiments of the invention. FIG. 1 is an exploded view of a cylinder core, generally referenced 10, in a lock device constructed in accordance with the invention. The core 10 is structured for placement in a circular-cylindrical opening 4 in a typical cylinder housing 2 and the core will therefore have an outer surface which corresponds essentially to the housing opening. The core includes a key way 12 which is configured to receive a key (not shown) in a typical fashion. The core 10 includes a plurality of pin tumbler openings 14 which receive tumbler pins (not shown) in a typical fashion. The manner in which an appropriately profiled key contacts the tumbler pins and places them on a parting line so that the core 10 can be rotated relative to the housing is known in the art and will not therefore will be described here in more detail.

The function or modus operandi of the tumbler pins is ignored throughout the entire description, and it is assumed and an appropriately profiled key has been inserted in the lock. When it is said, for instance, that the core is blocked or latched it is meant that the core is blocked by the electrically controlled latch mechanism described below.

FIG. 1 also illustrates a side bar 20 which is spring biased radially outwards by a spring 22 acting on the side bar. The function of the side bar is described in detail in, for instance, Swedish patent application 79067022-4, which is included by reference in the instant application.

The core also includes a generally cylindrical actuator 30 which can be rotated by means of a motor 40. The motor is connected to an electronic module 48 by means of two conductors 42*a*, 42*b*. These conductors extend in a groove in the barrel surface of the core. In addition to including a custom-made micro-regulating unit with an associated memory for storing and executing software together with drive circuits for driving the motor 40 etc, the electronic module also includes a key contact 44 in the form of an electrically conductive metal strip which is intended to make mechanical contact with a key inserted in the key channel 12. This enables the key and the electronic module to exchange electrical energy and data. Thus, a battery powering the motor 40 and the electronic module 48 can be placed either in the lock device or in the key.

A damping spring 46 is provided radially inwards of the motor for damping rotation of the motor 40.

Rotation of the actuator 30 can also be influenced by a pivotal pin 50 which has a rotational axle that extends generally at right angles to the rotational axis of the actuator. The pivotal pin is disposed in a channel (not shown) that extends up to the key way 12.

The side bar 20, the actuator 30 and the motor 40 with associated components, such as the damping spring 46, are disposed in a recess 10*a* in the barrel surface 10*b* of the core and are held in place by a cover 18. Correspondingly, the electronic module 48 is disposed in a recess in the barrel surface of the core opposite the recess 10*a*.

Figure 2A:
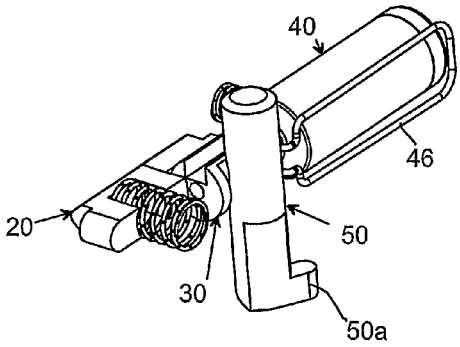
FIGS. 2*a* and 2*b* illustrate in detail a latch mechanism that comprises a side bar, an actuator, a motor, a pivotal pin, and a damping spring included in a lock device according to the present invention.
Figure 2B:
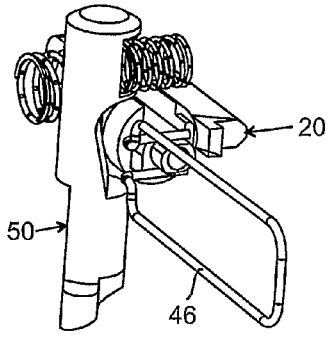

The latch mechanism is shown in more detail in FIGS. 2*a* and 2*b*, wherein the motor 40 has been omitted in FIG. 2*b*.

Figure 3A:
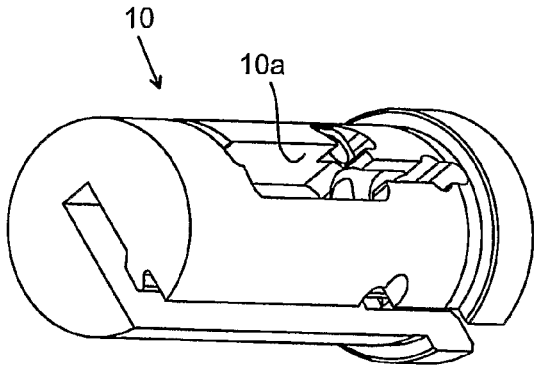
FIGS. 3*a-c* illustrate perspective views of a core comprised in a lock device according to the invention.
Figure 3B:
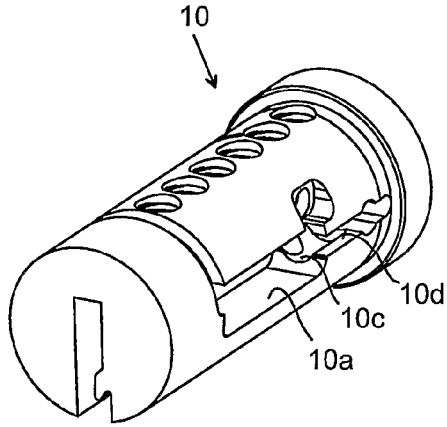
Figure 3C:
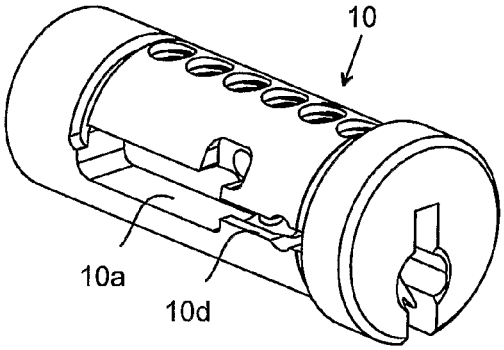
Figure 4:
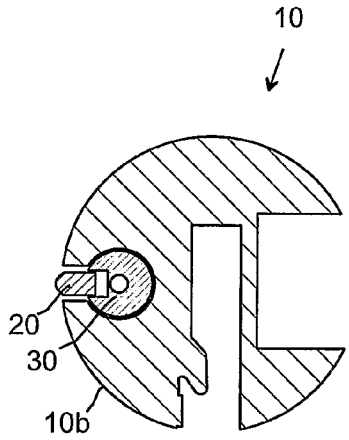
FIG. 4 illustrates a cross-section of the core in FIGS. 3*a-c* taken in level with the actuator of the latching mechanism.
Figure 5:
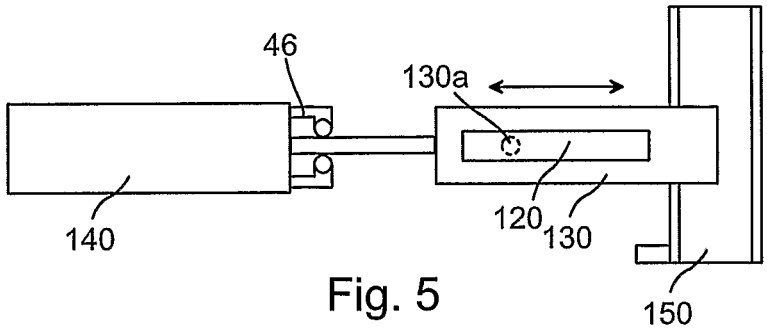
FIG. 5 illustrates a side view of the latching mechanism in an alternative embodiment of the invention.
Figure 6A:
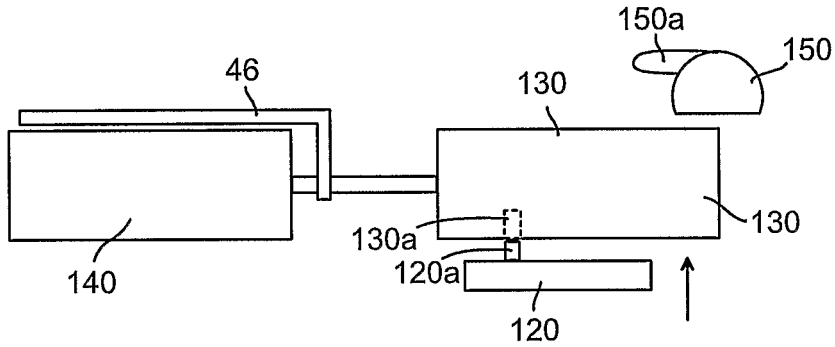
FIGS. 6*a-c* illustrate top views of the latching mechanism shown in FIG. 5.
Figure 6B:
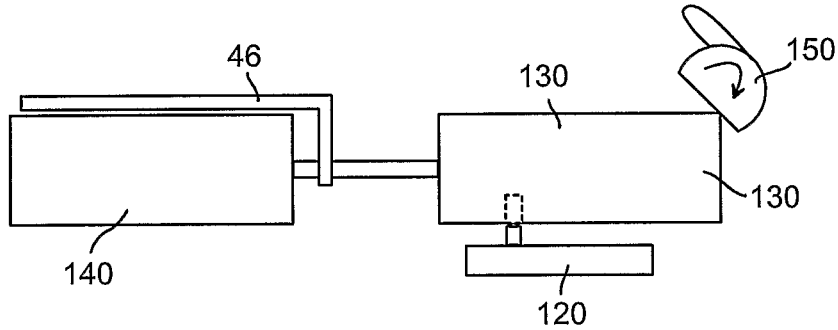
Figure 6C:
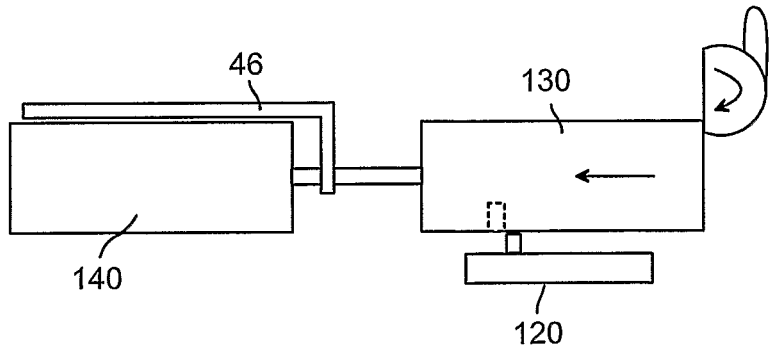

In FIGS. 3*a-c* there are shown different perspective views of the core 10, which all show the recess 10*a*. It is here evident that the recess 10*a* is provided at a distance from the end surfaces of the core. With the expression "at a distance" is also meant that you do not drill though the end surface in order to provide the recess, even though the provided opening later is sealed. The recess 10*a* later turns into an essentially circular bore 10*c*, which extends parallel with the longitudinal axis of the core and in which the actuator 30 is provided, see FIG. 4. It is also seen that the latching element in the form of the side bar 20 is provided in a slit 10*d* provided between the circular bore and the barrel surface of the core.

Because the lock device exhibits a circular bore, which extends parallel to the longitudinal axis of the core and in which the actuator is provided, good strength is obtained. This also applies to the placement of the side bar in a slit between the circular bore and the barrel surface of the core, which further enhances the security. The provision of the recess at a distance from the end surfaces of the core gives at the same time a flexible solution as regards assembly.

The slit 10*d* has preferably a width which essentially corresponds to the width of the side bar 20.

The described lock device is assembled in the following way. First the recess 10*a* is provided in the barrel surface of the core 10 by means of a cutter or mill. Thereafter, starting from the recess 10*a*, the circular bore 10*c* is provided by means of a ball mill. Then the pivotal pin 50, the springs 22, 46, and 52, the actuator 30 and the motor 40, the side bar 20 and finally the cover 46 are assembled in the above mentioned order. The motor and the actuator are placed so that the actuator is placed in the circular bore 10*c* while the side bar is placed in the slit 10*d*.

In an alternative embodiment illustrated in FIGS. 5 and 6*a-c*, the motor 40 with a rotating shaft has been replaced by a linearly operating motor or solenoid 140. This is connected to an actuator 130 which is movable in a longitudinal direction. A hole 130*a* is provided in the actuator 130, which hole is arranged to receive a pin 120*a* on a side bar 120. In the position illustrated in FIG. 6*a* the side bar can thus be moved towards the actuator since its pin is in registry with the hole 130*a*.

A damping spring 146 corresponding to the above described spring 46 abuts the shaft interconnecting the motor and the actuator.

A pivotal pin 150 corresponding to the pin of the first embodiment is provided for mechanical movement of the actuator during removal of the key from the lock device. It is thus provided with a pin 150*a* or other means making it possible to be influenced by means of a key inserted into the lock device. It is also spring biased by means of a spring (not shown). During turning of the pivotal pin, see FIG. 6*b*, a surface thereof presses against the end surface of the actuator, wherein the actuator is given a linear movement in the direction of the motor, see FIG. 6*c*. The hole 130*a* is thereby moved out of registry with the pin 120*a* of the side bar 120 and the side bar is thereby prevented from being moved inwardly towards the actuator. The actuator 130 is thereby given the same function as the rotating actuator 30 in the first embodiment. Although the actuator in this second embodiment is not rotating this latching mechanism can be assembled in a way corresponding to the way the latching mechanism of FIGS. 2*a* and 2*b* is assembled, i.e., the recess 10*a* and the circular bore 10*c* are replaced by spaces corresponding to the shape of the parts of the latching mechanism shown in FIGS. 5 and 6*a-c*.

A lock device according to the present invention and a method of assembling the same have been described with reference to preferred embodiments thereof. However, a person of average skill in this art will be aware that these can be varied within the scope of the accompanying claims.

Although a combination of an electrically controlled latch mechanism and conventional pin tumblers has been illustrated it will be understood that the concept of the invention can also be applied to lock devices that lack other latching devices than the electronically controlled latch mechanism described above.

The latching element has been described in the form of a side bar 20. It will be appreciated that the actuator 30 can cooperate with other kinds of latching elements, such as a latching pin with a function corresponding to that of the described side bar.

The expression bore has been used throughout this description for the space in which the actuator is provided. It will be appreciated that this expression should be interpreted broadly and that is to be considered to cover spaces for the actuator provided in different ways.

The invention claimed is:

1. A lock device comprising:

a housing (2) which includes an opening (4);

a core (10) which is rotatably mounted in the opening (4) about a longitudinal axis of the core and which includes a key way (12) for reception of a key;

a latching element (20;120) which co-acts between the housing (2) and the core (10) and which is movable between a release position in which the core is rotatable relative to the housing, and a latching position in which rotation of the core relative to the housing is blocked;

an electronically controllable actuator (30;130) which is mounted in the core (10) and which is movable by means of a motor between an opening-registering position in which movement of the latching element (20;120) to the release position is permitted, and a latching position in which movement of the latching element to said release position is blocked;

wherein the motor (40; 140) is provided in a recess (10*a*) in a barrel surface (10*b*) of the core at a distance from the end surfaces of the core;

a bore (10*c*) having a cross-section that essentially correspond to the cross-section of the actuator is arranged as a longitudinal extension of the recess (10*a*), which bore extends parallel to the longitudinal axis of the core and in which the actuator (30) is provided; and wherein the latching element (20; 120) is provided in a slit (10*d*) provided between the bore and the barrel surface of the core, wherein the recess opens at one radial side of the barrel surface of the core and the slit opens the bore at the one radial side of the barrel surface such that a mouth of the recess and the slit are arranged axially aligned in the barrel surface.

2. The lock device according to claim 1, wherein the slit (10*d*) exhibits a width essentially corresponding to the width of the latching element (20).

3. The lock device accordingly to claim 2, wherein the latching element is a side bar (20).

4. The lock device according to claim 1, wherein the latching element is a side bar (20).

5. A method of assembling a lock device comprising a housing (2) which includes an opening (4); a core (10) which is rotatably mounted in the opening (4) about a longitudinal axis of the core and which includes a key way (12) for reception of a key; a latching element (20) which co-acts between the housing (2) and the core (10) and which is movable between a release position in which the core is rotatable relative to the housing, and a latching position in which rotation of the core relative to the housing is blocked; and an electronically controllable actuator (30) which is mounted in the core (10) and which is movable by means of a motor between an opening-registering position in which movement of the latching element (20) to the release position is permitted, and a latching position in which movement of the latching element to said release position is blocked; said method comprising the following steps:

providing a recess (10*a*) in a barrel surface of the core;

providing a bore (10*c*) as a longitudinal extension of the recess (10*a*);

providing a slit (10*d*) between the bore and the barrel surface of the core;

providing the motor (40) in the recess and the actuator in the bore;

providing the latching element (20) in the slit; and providing the core in the opening, wherein the recess opens at one radial side of the barrel surface of the core and the slit opens the bore at the one radial side of the barrel surface such that a mouth of the recess and the slit are arranged axially aligned in the barrel surface.

6. The method according to claim 5, wherein the bore is provided by means of a ball mill.

7. The method according to claim 6, wherein the slit (10*d*) exhibits a width essentially corresponding to the width of the latching element (20).

8. The method according to claim 6, wherein the latching element is a side bar (20).

9. The method according to claim 5, wherein the slit (10*d*) exhibits a width essentially corresponding to the width of the latching element (20).

10. The method according to claim 9, wherein the latching element is a side bar (20).

11. The method according to claim 5, wherein the latching element is a side bar (20).

* * * * *